United States Patent [19]

Hopwood

[11] 4,252,321

[45] Feb. 24, 1981

[54] SPORTING EVENTS GAME

[75] Inventor: Ronald L. Hopwood, Camp Pendleton, Calif.

[73] Assignee: Rollin Woodruff, Mitchell, S. Dak.

[21] Appl. No.: 916,765

[22] Filed: Jun. 19, 1978

[51] Int. Cl.[3] ..... A63F 3/00

[52] U.S. Cl. ..... 273/247; 273/298

[58] Field of Search ..... 273/243, 247, 256, 274, 273/298

[56] References Cited

U.S. PATENT DOCUMENTS

| | | | |
|---|---|---|---|
| 1,683,860 | 9/1928 | Cahill | 273/260 |
| 2,930,621 | 3/1960 | Gross | 273/257 |
| 3,526,403 | 0/1970 | Clark | 273/247 |
| 3,649,023 | 3/1972 | Schohn | 273/271 |
| 3,730,528 | 0/1973 | Corrado | 273/247 |
| 3,889,954 | 6/1975 | Masilow | 273/256 |

*Primary Examiner*—Richard C. Pinkham
*Assistant Examiner*—Carl Moy
*Attorney, Agent, or Firm*—Duane C. Bowen

[57] ABSTRACT

Play money is wagered on supposed sporting events in which there are competing teams rated by point spreads. The game has various chance elements which includes particularly supposed point spreads and scores and which may include teasers, parlays and/or other events. Chance apparatus is selected from suitable chance devices such as decks of cards, a playing board with a series of playing spaces arranged in a playing course, dice and/or other chance instrumentalities.

12 Claims, 10 Drawing Figures

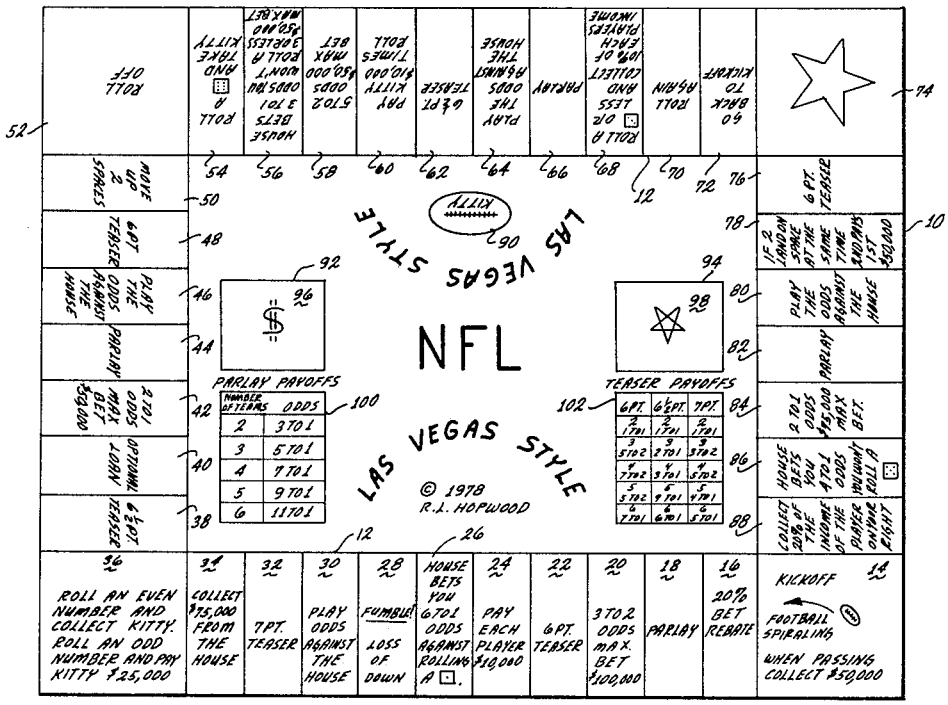

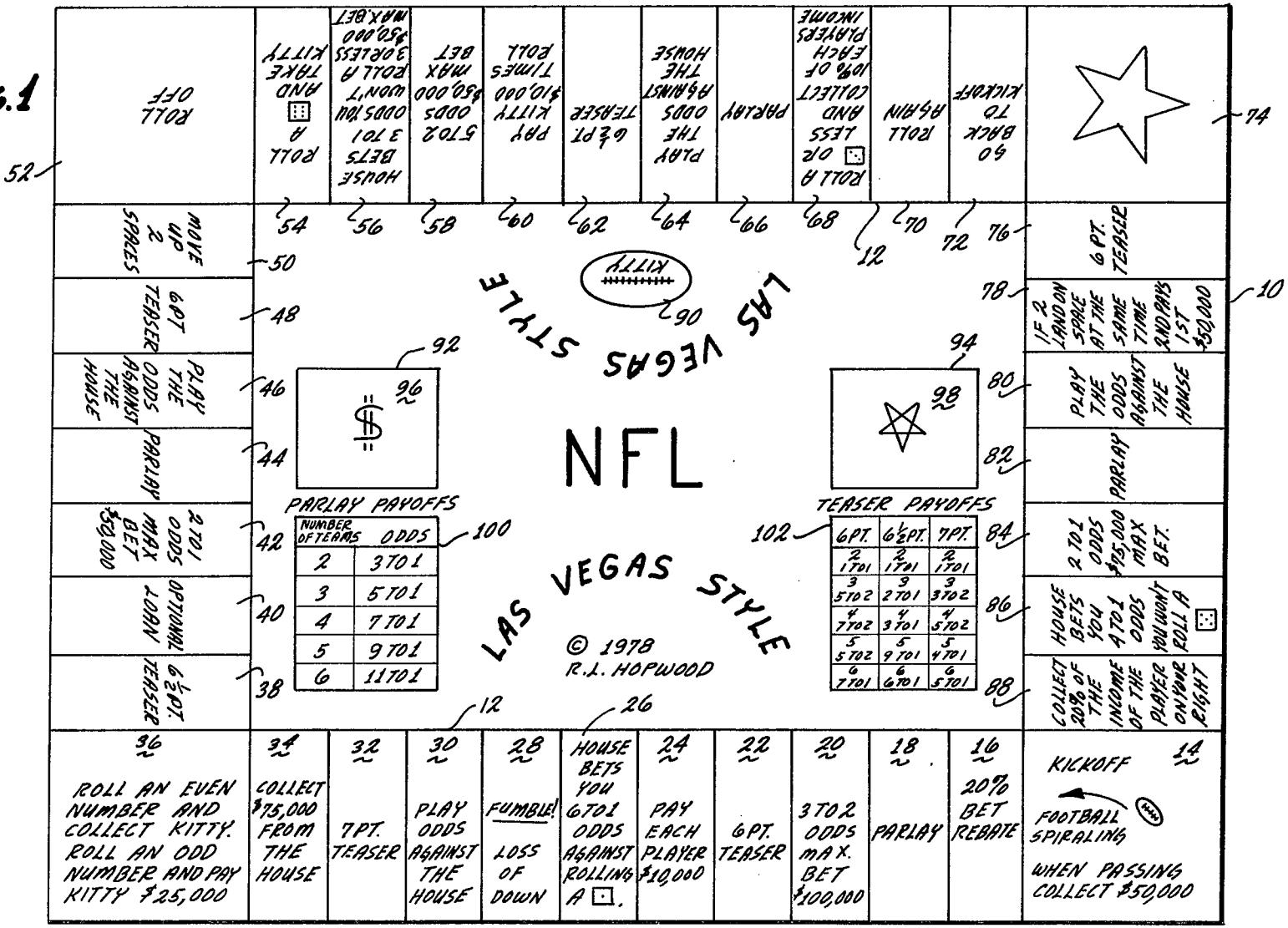
NFL
LAS VEGAS STYLE
LAS VEGAS STYLE
© 1978 R.J. HOPWOOD
KITTY
PARLAY PAYOFFS
NUMBER OF TEAMS
ODDS
2 3 TO 1
3 5 TO 1
4 7 TO 1
5 9 TO 1
6 11 TO 1
TEASER PAYOFFS
6 PT.
6½ PT.
7 PT.
2 1 TO 1
3 5 TO 2
4 7 TO 2
5 5 TO 2
6 7 TO 1
2 1 TO 1
3 2 TO 1
4 3 TO 1
5 9 TO 1
6 7 TO 1
2 1 TO 1
3 3 TO 2
4 5 TO 2
5 4 TO 1
6 5 TO 1
ROLL AN EVEN NUMBER AND COLLECT KITTY. ROLL AN ODD NUMBER AND PAY KITTY $25,000
COLLECT $75,000 FROM THE HOUSE
7 PT. TEASER
PLAY ODDS AGAINST THE HOUSE
FUMBLE! LOSS OF DOWN
HOUSE BETS YOU 6 TO 1 ODDS AGAINST ROLLING A ⚀.
PAY EACH PLAYER $10,000
6 PT. TEASER
3 TO 2 ODDS MAX. BET $100,000
PARLAY
20% BET REBATE
KICKOFF
FOOTBALL SPIRALING
WHEN PASSING COLLECT $50,000
COLLECT 20% OF THE INCOME OF THE PLAYER ON YOUR RIGHT
HOUSE BETS YOU 4 TO 1 ODDS YOU WON'T ROLL A ⚀
2 TO 1 ODDS $75,000 MAX BET
PARLAY
PLAY THE ODDS AGAINST THE HOUSE
IF 2 LAND ON SPACE AT THE SAME TIME AND PAYS 1ST $50,000
6 PT. TEASER
OPTIONAL LOAN
6½ PT. TEASER
PLAY THE ODDS AGAINST THE HOUSE
PARLAY
6½ PT. TEASER
PAY KITTY $10,000 TIMES ROLL
MAX BET 5 TO 2 ODDS $50,000
HOUSE BETS 3 TO 1 ODDS WON'T ROLL A ⚀ 3 OR LESS $50,000 MAX BET
ROLL A ⚀ AND TAKE KITTY
ROLL 2 TO 12 AND COLLECT 20% OF EACH PLAYERS INCOME
PARLAY
PLAY THE ODDS AGAINST THE HOUSE

FIG. 2

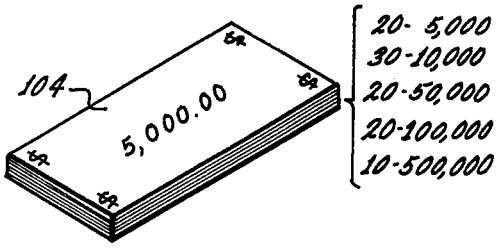

FIG. 3

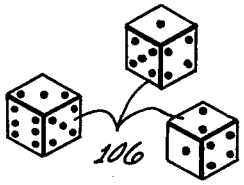

FIG. 4A

POINT SPREAD CARD

96

| FAVORITE | PT. | UNDERDOG |
|---|---|---|
| DALLAS | 2 | OAKLAND |
| MINNESOTA | 4 | DETROIT |
| DENVER | 0 | DALLAS |
| MIAMI | 3 | BUFFALO |
| PITTSBURGH | 4 | HOUSTON |
| N.Y. JETS | 0 | SAN DIEGO |

FIG. 4B

POINT SPREAD CARD

96

| FAVORITE | PT. | UNDERDOG |
|---|---|---|
| MIAMI | 4 | CINCINNATI |
| LOS ANGELES | 0 | PHIL. |
| WASHINGTON | 1 | ST LOUIS |
| BUFFALO | 3 | CHICAGO |
| S.F. 49ER'S | 2 | HOUSTON |
| PITTSBURG. | 4 | N.Y. GIANTS |

FIG. 7

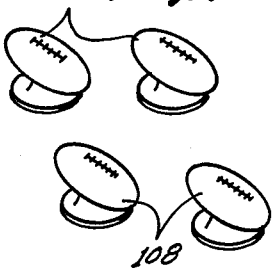

FIG. 5

98

| | SCORES |
|---|---|
| 1 | 17 - 10 |
| 2 | 19 - 7 |
| 3 | 3 - 10 |
| 4 | 21 - 27 |
| 5 | 24 - 35 |
| 6 | 21 - 20 |

FIG. 6A

110

| FAVORITE PT. | 6PT. | 6½PT. | 7PT. |
|---|---|---|---|
| 1 | 5PT. | 5½PT. | 6PT. |
| 2 | 4PT. | 4½PT. | 5PT. |
| 3 | 3PT. | 3½PT. | 4PT. |
| 4 | 2PT. | 2½PT. | 3PT. |
| 5 | 1PT. | 1½PT. | 2PT. |
| 6 | 0PT. | ½PT. | 1PT. |

FIG. 6B

112

| UNDERDOG PT | 6PT. | 6½PT. | 7PT. |
|---|---|---|---|
| 1 | 7PT. | 7½PT. | 8PT. |
| 2 | 8PT. | 8½PT. | 9PT. |
| 3 | 9PT. | 9½PT | 10PT. |
| 4 | 10PT. | 10½PT. | 11PT. |
| 5 | 11PT. | 11½PT. | 12PT. |
| 6 | 12PT. | 12½PT | 13PT. |

114

| PUT TEAM + POINT SPREAD IN CORRECT GAME #SPACE | | | | |
|---|---|---|---|---|
| 1 | 1 | 1 | 1 | 1 |
| 2 | 2 | 2 | 2 | 2 |
| 3 | 3 | 3 | 3 | 3 |
| 4 | 4 | 4 | 4 | 4 |
| 5 | 5 | 5 | 5 | 5 |
| 6 | 6 | 6 | 6 | 6 |
| 1 | 1 | 1 | 1 | 1 |
| 2 | 2 | 2 | 2 | 2 |
| 3 | 3 | 3 | 3 | 3 |
| 4 | 4 | 4 | 4 | 4 |
| 5 | 5 | 5 | 5 | 5 |
| 6 | 6 | 6 | 6 | 6 |
| 1 | 1 | 1 | 1 | 1 |
| 2 | 2 | 2 | 2 | 2 |
| 3 | 3 | 3 | 3 | 3 |
| 4 | 4 | 4 | 4 | 4 |

FIG. 8

SPORTING EVENTS GAME

BRIEF SUMMARY OF THE INVENTION AND OBJECTIVES

My invention relates to game apparatus and a method of playing a game revolving around supposed sporting events, point spreads and scores.

I observed in visiting Las Vegas that one form of wagering of high popularity relates to sporting events in which there are competing teams, in which point spreads are given, and in which scores are affected by the point spreads in determining outcomes of wagers. It occurred to me that possibly a board game or the like could be built around supposed sporting event point spreads and scores and further around some other aspects of Las Vegas sporting events wagering, such as teasers, parlays, etc. I experimented extensively with methods of play and game apparatus and arrived at a method and apparatus in which: a game progresses at a suitably exciting rate; in which there is sufficient variety of events; in which there are enough requirements for calculations and the like, in addition to chance elements, to make the game mentally challenging; and in which there is sufficient relationships to actual betting in Las Vegas to favorably color the game experience.

The objectives of my invention include to devise game apparatus and method of play revolving around supposed sporting event point spreads and scores; to add other suitable features including other aspects of Las Vegas sporting event wagering such as teasers and parlays; to devise a suitable blend of chance elements and elements requiring mental processes; to provide a game progressing at an exciting rate; to devise a game having sufficient relationships to actual wagering experience in Las Vegas on current sporting events to add extra interest to the game.

My invention will be best understood, together with additional objectives and advantages thereof, from the following description, read with reference to the drawings in which:

FIG. 1 is a plan view of the playing board illustrating a specific embodiment of my new invention.

FIG. 2 is an illustration relating to play money.

FIG. 3 is a perspective view of three dice.

FIGS. 4A and B are plan views of point-spread cards.

FIG. 5 is a plan view of a scores card.

FIGS. 6A and B are plan views of teaser computing cards.

FIG. 7 is a perspective view of player space marking objects which are shown as resembling footballs.

FIG. 8 is a plan view of a sheet for recording teaser and parlay wagers.

DESCRIPTION OF THE INVENTION

I have used the word "supposed" in the above description in expressions like "supposed sporting events". By this word I mean that there is the appearance of one of more actual sporting events, point spreads, and scores, but there are no real sporting events occurring as listed. If the subject were football games, actual college or professional teams might or might not be listed but, obviously in a game manufactured much before the time of play, it is unlikely actual games as listed are being currently played. If a game of Denver versus Oakland is listed, there is no reason to suppose the next contest of the two teams is against each other at the time the game is being played or even that it is football season, although it may add a valuable note of realism that Denver and Oakland are in the same Division and may play twice in a season. Such games are "supposed" to be currently occurring although they are not actually occurring.

By the expression "supposed sporting events", I do not mean to exclude the possibility that the sporting events might have been drawn from actual games in the past, like professional football games in the 1977 season, basketball games in the NCAA playoffs in prior seasons, World Series baseball games in the 30's and 40's, a hockey team's actual schedule in a prior year, etc. In this sense, the sporting events are supposed to be currently occurring although actually they occurred in the past. Note that such information on past seasons could be interesting or emotionally involving. Supplemental information could be supplied. If some player remembered some of what actually occurred in the past to guide his wagering, nothing much would be lost as wagering would be with play money for fun.

An additional note is that the sporting events involved in my game have scores so that point spreads are applicable. Thus, boxing events would be inapplicable because decisions are merely in terms of win-lose. The sporting events with suitable scores and of suitable interest, that I can think of, involve team contestants rather than individual contestants.

I will describe a specific embodiment of my invention of game apparatus and method of playing a game. First, I would like to note, however, that some substitutions may be made for some game chance elements shown. A spinner (balanced pivotal needle or arrow spinning to point to various clocked stations each having a legend designating the effect of the arrow pointing at the station) can be used instead of dice. A game board having a playing course with a series of serially disposed playing spaces identified as to playing function by a series of indicia plus dice to determine which space a player lands on can be simulated by a deck of cards having a series identified by the same series of indicia. Although I use decks of cards to determine by chance the point spreads and the scores, a board and dice or even large spinners could provide point spreads and scores by chance. However, my experience thus far is that the use of the playing board, dice, card decks, etc., as shown, works very well in achieving the game play and method involved in the present invention.

Equipment involved in the specific embodiment of my game shown in the drawings includes the following:

(a) A playing board 10 including an endless playing course 12 having a series of serially disposed playing spaces 14–88. The board also has an area 90 designated as a "KITTY", rest spots 92, 94 which normally will be occupied respectively by decks of point-spread and score cards 96, 98, and indicia forming parlay payoff and teaser tables 100, 102.

(b) Play money 104, as displayed in FIG. 2.

(c) Dice 106.

(d) Player markers 108, i.e., to mark which spaces 14–88 the players are on, relative to playing course 12. Depending on what sport or sports the particular game is devoted to, markers 108 may be appropriately configured, i.e., footballs here.

(e) Cards having tables 110, 112 (or one card printed according to 110 on one side and according to 112 on the other side) useful in computing teaser calculations.

(f) A sheet 114 (or a tablet of such sheets) useful in recording teaser and parlay wagers.

To explain the operation of my invention, I will follow generally the format of a set of instructions and rules for the game, with some elaboration, extra explanation, reference to the drawings, etc., that would not be contained in such instructions and rules. It will be understood that this is but one set of instructions and rules, that a number of features are optional additions to the basic game outlined above, and that a widely different set of instructions and rules could be equally applicable to the basic game. As indicated before, the most basic features of the game involve chance as to point spreads and chance as to scores to determine the outcome of wagers. With the above qualifications in mind, it is believed the basic form of instructions and rules is a good way to set forth and illustrate a specific embodiment of my game apparatus and method.

GAME INSTRUCTION AND RULES by Ronald Leif Hopwood

© 1978 R. L. Hopwood

Object of the Game

The object of the game is to use the $100,000 starting money (from play money 104) to be the first player to make a million dollars. The million dollars is earned by wagering in the process of landing on playing spaces 14–88 on playing board 10 and in following the specifications on those spaces 14–88.

Starting the Game (1) The game can be played by two to four players. Each player selects a marker 108 (that may have different shapes, colors or team identifications) to use to mark his position on the endless playing course 12. If two players want the same object 108, they roll dice 106 for it.

(2) Each player receives a teaser or parlay recording pad 114 and a pencil, and a set of teaser calculation tables 110, 112. A series (i.e., a couple of dozen) of point-spread cards 96 are shuffled and placed face down on the marked location 92 on the board and a series of score cards 98 are shuffled and placed face down on the marked location 94 on board 10. One way to identify which location is which, is to put a "$" sign in space 92 and on the back of cards 96 and to put a "star" sign in space 94 and on the back of cards 98. Note that each point-spread card 96 has six point spreads between professional football teams and each score card 98 has six scores, i.e., when the card of FIG. 4A and the card of FIG. 5 are drawn by a player, the score 17-10 would apply to the Dallas-Oakland game, the score 19-7 would apply to the Minnesota-Detroit game, etc.

(3) Each player receives $100,000 in play money 104 from the house (bank). The assortment of denominations set forth in FIG. 2 has proven to be a suitable amount and assortment for the initial bank. A player receives another $50,000 each time he passes the kickoff space 14, except when he reaches kickoff space 14 by landing on "Go Back to Kickoff" 72.

(4) The Kitty 90 starts out with $100,000.

(5) Players roll one dice 106 each to see who goes first.

(6) Upon each player's turn to move, one dice is rolled and the player's token 108 is advanced corresponding to the number rolled. On the first play, the player's token is on "Kickoff" 14 before the dice is rolled.

Collecting Money

The house pays all winnings, etc., except for amounts paid by the Kitty 90 or by other players incident to players landing on such spaces as "Pay Each Player $10,000" 24, "Roll an Even Number and Collect Kitty", etc., 36, "Roll a Six and Take Kitty" 54, "Pay Kitty $10,000 Times Roll" 60, "Roll a Three or Less and Collect 10% of Each Player's Income" 68, "If 2 Land on Space at Same Time, 2nd Pays 1st $50,000" 78, and "Collect 20% of the Income of the Player on Your Right" 88. All payoffs of whatever nature are rounded to the nearest $5000.

Placing Bets (1) All players place bets on playing board 10.

(2) Players who forget to put down bets before looking at score cards 98, pay the house $20,000 fine and lose turn.

Teasers (1) Whenever landing on a block marked with a teaser (22, 32, 38, 48, 62, 76), a player must bet on at least two teams and can bet up to six teams with the payoffs changing as shown on the board by Teaser Payoffs table 102, depending on whether 2, 3, 4, 5 or 6 teams are wagered upon. The player draws the point-spread card 96 on the top (after a play, cards 96, 98 are put on the bottom of their piles) and selects two or more teams on which he wants to bet in the teaser. The player adds the points indicated on the teaser block on course or track 12 to the points indicated on the point spread card. For example:

| | Favorite | Pt. | Underdog |
|---|---|---|---|
| 1 | Dallas | 3 | Denver |
| 2 | Miami | 4 | N.Y. Jets |
| 3 | St. Louis | 3 | Chicago |
| 4 | N. Orleans | 0 | Tampa |
| 5 | Pittsburgh | 4 | Washington |
| 6 | Philadelphia | 2 | Cleveland |

If the player had a 7 Point Teaser (32) and selected Dallas, Washington and Tampa, the computation would be as follows: Dallas is plus 7 (teaser) minus 3 (favored spread), for a total of plus 4. Washington is plus 7 plus 4 (underdog spread), for a total of plus 11. Tampa would be plus 7 (teaser) and no change as the spread is zero, for a total of plus 7.

To make these calculations easier, the tables 110, 112 are provided on a card or cards for player uses. Looking at FIG. 6A for the Favorite Dallas, in the right-hand column for the 7 point teaser, opposite the 3 point spread is the 4 point resultant. Looking at FIG. 6B for the Underdog Washington and resorting to the 7 point right hand column, the resultant of a 4 point spread is the 11 point resultant. As to the zero point spread for Tampa, 7 points is the direct resultant.

(2) The player on the right of the wagering player records the wager, preferably on a sheet 114 (FIG. 8). Following the above example, the recording would be:

| | |
|---|---|
| 1 | Da +4 |
| 2 | $10,000 |
| 3 | |

-continued

| | |
|---|---|
| 4 | T +7 |
| 5 | W +11 |
| 6 | |

The amount of the wager (here $10,000) can be put on any vacant space.

(3) The wagering player must win all games wagered upon in order to collect. In the above example of a $10,000 wager, if the wagering player draws a score card as follows:

| Scores | |
|---|---|
| 1 | 13–7 |
| 2 | 21–28 |
| 3 | 0–3 |
| 4 | 7–6 |
| 5 | 48–38 |
| 6 | 20–21 |

In the first game, Dallas would have 13 plus 4, thereby winning the wager over Denver 17 to 7. In the fourth game, Tampa would have 6 plus 7, thereby winning the wager over New Orleans 13 to 7. In the fifth game, Washington would have 38 plus 11, thereby winning the wager over Pittsburgh 49 to 48. Having won all of the three games wagered upon, the wagering player wins and may consult the Teaser Payoffs 102 or board 10 for his payoff. The right hand, 7 point teaser column, shows under the numeral "3", for three games wagered upon, "3 to 2", which means the player will collect $15,000 from the house for his $10,000 wager. If on the other hand, the above computation, according to the score card drawn, showed a loss by Dallas, Tampa or Washington, the player would have lost $10,000 to the bank. If a player selects 2 teams and wins one and ties one, the wager is cancelled. If a player selects 3 teams and wins two and ties one, the player is paid like a two team teaser; and for 4 teams, 3 losses and one tie, is treated like a three team teaser, and so forth.

(4) If a wagering player wins a teaser, it is the job of the player on his right to make sure he computes his wager correctly. If the wagering player makes any mistake, he automatically loses.

Parlays

Parlays (spaces 18, 44, 66 and 82) involve a maximum bet of $25,000. A player on a parlay space can bet on from 2 to 6 teams. Winning wagers are determined by point-spread cards 96 and score cards 98. Parlays are handled like teasers (above) except point-spreads are not changed from cards 96. Payments (table 100 on board) are higer than teasers because winning is more difficult without change of point-spreads 96.

Point-Spread Cards

Point-spread cards 96 state which team is favored and by how much. The team in the left hand column is the favorite and the team in the right hand column is the underdog. The point column shows how many points the favorite is favored over the underdog. If according to FIG. 4A a player were to bet on Dallas over Oakland (in the absence of a teaser or a parlay), with the two point spread given, the score card 98 would have to show a win in the first game by the first listed team by at least two points to tie (resulting in "no-bet") and by at least three points to win.

Score Cards

The score cards 98 show the results of the games. The favored team has the first-mentioned score on the left and the underdog team has the second-mentioned score on the right in each case.

Bet Rebates

Space 16 involves a twenty-five percent bet rebate when a wager is made on a team of the player's choice on a point-spread card 96. If a player bets $40,000, for example, he would be paid $40,000 if he wins but he would pay the house $40,000 less 25% ($10,000) for a net of $30,000 if he loses. Only one team can be bet upon. In case of a tie, the play is considered no-action and no money is paid or received.

Roll Off

When a player lands on roll off space 52, he selects another player and tries to roll a higher number with one dice than the other player. The winner collects 25% of the loser's assets. In case of ties, the roll off is repeated.

Play the Odds Against the House

Spaces 30, 46, 64 and 80 involve playing the odds against the house. The player rolls 3 dice. The total of the rolled numbers of the 3 dice is the odds the house bets the player that the player will not roll a higher total on the three dice on the next roll. If the player rolled dice adding to a total of 14, for example, the house would then bet the player 14 to 1 that the player would not roll a total on the dice in excess of 14 on the next roll. The maximum bet is $20,000. If $20,000 were bet in the above example and the player won, the house would pay him 14 times $20,000 for a total of $280,000. If the player lost, however, he would have only paid $20,000. In case of a tie, the house would collect as the player is rolling to beat the house.

Borrowing and Paying Off Debts (1) All debts are rounded to the closest $5,000 digit.

(2) A player may need to borrow money at certain times to pay the Kitty. A player involuntarily may run short, by landing on space 36, requiring rolling against the Kitty, or by landing on space 60, requiring payment to the Kitty of $10,000 times the roll (in both cases, the roll of the dice in question is a roll after the roll that landed the player on the particular space). If the player loses in rolling against the Kitty while he is on space 36 or to make payments relative to space 60, the player may need to borrow to pay his debts or to finance further betting, although normally a player can only make (an optional) loan (space 40) when passing that space. Only in this involuntary debt situation can the player borrow (up to $100,000) to pay the Kitty before reaching the optional loan space 40. Wagering is not required in landing on most spaces if a player is broke. Exceptions, in addition to spaces 36 or 60, that do require wagering or payments include spaces 24 (Pay Each Player $10,000) and 26, 46, 56, 64, 78, 86 and 88 (against the house) and in those cases a player goes out if he can't pay the wager.

(3) Players may take out optional loans (space 40) only when passing that space. Players wanting to take out optional loans must stop at the optional space 40 although they roll a dice otherwise advancing them beyond space 40. The optional loan is always $100,000.

If a player is in debt, he must stop at the optional loan space 40 and pay back 25% of the loan ($25,000) each time he passes space 40. Another loan cannot be taken out until the first loan is paid off. If a player does not have enough funds to pay 25% of the loan ($25,000), he goes out of the game.

Star

Whenever a player lands on the symbol of a star (space 74), the player rolls one dice and collects $25,000 times the number he rolls.

A Player is Out (1) A player is out when he can not make needed payments, i.e., when he is broke and lands on a space (other than spaces 36 and 60 discussed above) requiring him to make a wager.

(2) When he cannot pay off an optional loan as provided above.

The Game is Over

The game is over when all players but one is broke or when a player reaches a million dollars in assets.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. Game apparatus for playing a game relating to wagering on sporting events, comprising:

(a) a playing board including a playing course having a series of serially disposed playing spaces provided with indicia means for identifying respective spaces according to the indicia thereof; certain of said spaces being sporting event wagering spaces and having indicia means identifying them as calling for wagers by players on sporting events;

(b) a deck of point-spread cards adapted to be drawn by chance during game play when a playing piece lands upon one of the sporting events wagering spaces and each card having indicia indicating point-spreads in at least a first sporting event so the player can wager depending on at least one event; and (c) a deck of score cards adapted to be drawn by chance during game play after a player has wagered on at least one event listed on said point-spread cards and having indicia indicating the score in at least said first sporting event so that a determination can be made whether the play won according to the applicable point-spread and the score.

2. The subject matter of claim 1 in which there are a plurality of playing pieces for traversing said playing course by each player, and chance means operable by players in sequence for determining the number of spaces to be traversed per turn by a playing piece.

3. The subject matter of claim 1 in which said playing spaces includes teasers of various values and indicia indicating upon a player reaching a teaser playing space that teaser rules are to apply, indicating changed point-spreads, indicating at least two sporting events must be wagered upon, and indicating changed betting odds.

4. The subject matter of claim 1 in which said playing spaces include teaser, parlay, and optional loan spaces and include spaces involving wagers determined by rolling dice means and indicia indicating upon a player reaching a teaser or parlay playing space that teaser or parlay rules are to apply, indicating changed point-spreads, indicating at least two sporting events must be wagered upon, and indicating changed betting odds.

5. The subject matter of claim 1 in which each point-spread card lists a series of specific sporting events in sequence and sets forth a point-spread for each specific sporting event, and in which each score card lists a series of scores in sequence which correspond to the specific sporting events in the same sequence as on said point-spread cards.

6. Apparatus for playing a game relating to wagering on sporting events, comprising:

(a) a first point-spread indicating chance means having a multiplicity of separate printed point-spread indicia each giving at least one point-spread for a sporting event operable by a player during game play when the player is to wager to indicate by chance which point-spread indicia is to apply in at least a first sporting event involving opposing sporting teams;

(b) a separate second score indicating chance means having a multiplicity of separate printed score indicia each giving at least one score operable by a player during game play after the player has wagered using said point-spread chance means to indicate by chance which score indicia is to apply to determine whether the player has won in view of the particular point-spread and score involved in the play, and (c) said first means being a deck of point-spread cards, each having at least one point-spread printed thereon, and said second means being a deck of score cards, each having at least one score printed thereon.

7. The subject matter of claim 6 in which each point-spread card lists a series of specific sporting events in sequence and sets forth a point-spread for each specific sporting event, and in which each score card lists a series of scores in sequence which correspond to the specific sporting events in the same sequence as on said point-spread cards.

8. Apparatus for playing a game relating to wagering on sporting events, comprising:

(a) a first point-spread indicating chance means having a multiplicity of separate printed point-spread indicia each giving at least one point-spread for a sporting event operable by a player during game play when the player is to wager to indicate by chance which point-spread indicia is to apply in at least a first sporting event involving opposing sporting teams;

(b) a separate second score indicating chance means having a multiplicity of separate printed score indicia each giving at least one score operable by a player during game play after the player has wagered using said point-spread chance means to indicate by chance which score indicia is to apply to determine whether the player has won in view of the particular point-spread and score involved in the play, and (c) a third teaser chance means operable by a player during game play when the player is to wager occasionally indicating that teaser rules are to apply, that point spreads are to change, that at least two sporting events must be wagered upon, and that the player must be successful in wagering in all events, in which case the betting odds are improved.

9. The subject matter of claim 8 in which said apparatus includes a playing course having a series of serially disposed playing spaces and player operated chance means to indicate which space a player is to land upon and said third teaser chance means including indicia that at least one playing space is a teaser space.

10. Apparatus for playing a game relating to wagering on sporting events, comprising:

(a) a first point-spread indicating chance means having a multiplicity of separate printed point-spread indicia each giving at least one point-spread for a sporting event operable by a player during game play when the player is to wager to indicate by chance which point-spread indicia is to apply in at least a first sporting event involving opposing sporting teams;

(b) a separate second score indicating chance means having a multiplicity of separate printed score indicia each giving at least one score operable by a player during game play after the player has wagered using said point-spread chance means to indicate by chance which score indicia is to apply to determine whether the player has won in view of the particular point-spread and score involved in the play, and (c) a parlay chance means operable by a player during game play when the player is to wager occasionally indicating that parlay rules are to apply; that at least two sporting events must be wagered upon; and that the player must be successful in wagering in all events, in which case the betting odds are improved.

11. The subject matter of claim 10 in which said apparatus includes a playing course having a series of serially disposed playing spaces and player operated chance means to indicate which space a player is to land upon and said parlay chance means including indicia that at least one playing space is a parlay space.

12. Apparatus for playing a game relating to wagering on sporting events, comprising:

(a) a first point-spread indicating chance means having a multiplicity of separate printed point-spread indicia each giving at least one point-spread for a sporting event operable by a player during game play when the player is to wager to indicate by chance which point-spread indicia is to apply in at least a first sporting event involving opposing sporting teams;

(b) a separate second score indicating chance means having a multiplicity of separate printed score indicia each giving at least one score operable by a player during game play after the player has wagered using said point-spread chance means to indicate by chance which score indicia is to apply to determine whether the player has won in view of the particular point-spread and score involved in the play, (c) a player action sequence chance means determining the order of play among a series of types of play, and at least one type of play being wagering on sporting events using said first point-spread indicating chance means and said second score indicating chance means, and (d) said player action sequence chance means including a playing board having a series of serially disposed playing spaces provided with indicia means for indentifying respective spaces according to the indicia thereof and certain of said spaces being sporting event wagering spaces and having indicia means identifying them as involving wagers on sporting events, and chance means operable by players in sequence for determining the number of spaces on said board to be traversed by the players.

* * * * *